United States Patent [19]

Ilsemann

[11] Patent Number: 4,523,422

[45] Date of Patent: Jun. 18, 1985

[54] APPARATUS FOR INTRODUCING TAPE CASSETTES OR THE LIKE AND SUPPLEMENTS INTO HINGED BOXES

[76] Inventor: Heino Ilsemann, Am Wehkamp 3, 2800 Bremen, Fed. Rep. of Germany

[21] Appl. No.: 572,422

[22] Filed: Jan. 20, 1984

[30] Foreign Application Priority Data

Jan. 22, 1983 [DE] Fed. Rep. of Germany ..... 3302112

[51] Int. Cl.[3] ..... B65B 57/06; B65B 43/39

[52] U.S. Cl. ..... 53/566; 53/238; 53/253; 53/382

[58] Field of Search ..... 53/377, 382, 386, 266 R, 53/53, 566, 564, 238, 253

[56] References Cited

U.S. PATENT DOCUMENTS

| | | | |
|---|---|---|---|
| 3,507,088 | 4/1970 | Mizelle et al. | 53/53 |
| 3,517,477 | 6/1970 | Thornton | 53/53 |
| 4,185,200 | 1/1980 | Müller et al. | 53/266 R |
| 4,201,027 | 5/1980 | Ilsemann | 53/53 |
| 4,234,795 | 11/1980 | Müller | 53/266 R |
| 4,297,826 | 11/1981 | Woertche | 53/382 X |

FOREIGN PATENT DOCUMENTS 2333506 7/1973 Fed. Rep. of Germany .

*Primary Examiner*—Horace M. Culver

*Attorney, Agent, or Firm*—Hill, Van Santen, Steadman & Simpson

[57] ABSTRACT

An apparatus for introducing tape cassettes or the like together with supplements into hinged boxes including a turret which is arranged to rotate step-by-step about a horizontal axis and containing holding means for the hinged boxes. The hinged boxes are fed from below into one of the holding means in a hinged box insertion station which lies essentially vertically below the axis of rotation of the turret. In a cassette and supplement insertion station lying essentially horizontally in the plane of the axis of rotation of the turret, tape cassettes and supplements are supplied and inserted into an at least partially opened hinged box. An ejection station is positioned essentially horizontally in the plane of axis of rotation of the turret and is offset by approximately 180° relative to the cassette and supplement insertion station. The holding means comprise two pivotal flaps which can be selectively brought into different positions in the various stations.

10 Claims, 8 Drawing Figures

APPARATUS FOR INTRODUCING TAPE CASSETTES OR THE LIKE AND SUPPLEMENTS INTO HINGED BOXES

BACKGROUND OF THE INVENTION

1. Field of the Invention

This invention is directed to an apparatus for introducing tape cassettes or the like and printed supplements into hinged boxes, utilizing a turret rotating on a horizontal axis in step-by-step increments. A hinged box insertion station is positioned vertically below the axis of rotation of the head and into which the tape cassettes and supplements are fed. A cassette and supplement insertion station is positioned horizontally in the plane of the axis of rotation into which a tape cassette and a supplement are inserted into an at least partially opened hinged box. An ejection station is positioned essentially horizontally in the plane of the axis of rotation of the turret and is offset relative to the cassette and supplement insertion station.

2. Description of the Prior Art

An apparatus for introducing tape cassettes and supplements into hinged boxes is known from DE-OS No. 23 33 506 wherein hinged boxes are held clamped in the rotating head in compartments. After the individual hinged boxes have been accepted within a compartment of the rotary head, they are opened by a ram disposed outside the rotary head in the direction of rotation for insertion of the individual hinged boxes into the compartments. The ram presses against an end wall of the lower part of the hinged box and restrains the lower part at the rotational step of the turret. Consequently, the hinged box is opened to such a degree that the lower part of the hinged box is abutted against the wall of the compartment extending obliquely back from the radius at an acute angle in the direction of rotation. Subsequently, first the supplements and then the cassettes are inserted into the hinged box which is half opened as mentioned previously in two separate work stations whereupon the hinged box is then rotated further and is sent to a closing means disposed outside of the rotary head and is closed there. The overall consequence is that the rotary head must be stopped a total of twelve times during one revolution. The number of stations in which work steps must be executed not only involves the necessity of considerable disruptions in operations, but the manner in which the hinge boxes are merely held at their covers by means of clamping fingers also involves the inherent danger that the hinged boxes will slide out of their compartments. Thus, the known apparatus is subject to disruptions whereby it is also difficult to vary the type of supplement to be inserted or the number of supplements to be provided with an individual cassette since adequate positioning possibilities at the circumference of the rotary head are not available for this purpose.

An apparatus for introducing tape cassettes or the like and supplements into hinged boxes is also shown in DE-OS No. 27 37 196, (U.S. Pat. No. 4,201,027) the disclosure of which is incorporated herein by reference. This apparatus has proved itself in practice and provides a turret which rotates on a vertical axis of rotation. Holding means for the cassettes are essentially tangentially disposed in such manner that the lower part of the hinged boxes lies in the holding means of a tangential plane relative to the axis of rotation of the turret, whereby the covers of the hinged boxes can be pivoted around pivotal axes lying in a tangential plane by means of devices provided for this purpose. The permissive variation with respect to the introduction of various supplements is not as great as would be desirable and it is desirable to improve the cycle speed of the apparatus with reduced outlay.

SUMMARY OF THE INVENTION

The present invention seeks to provide an improved apparatus of the type described such that a greater scope of variation with respect to the introduction of different supplements is provided with a reduced susceptibility to disruption.

In accordance with the present invention, there is provided a holding means having a cover flap carrying a suction device and serving to open and close the cover of the hinged box. The holding device also includes an underside flap comprising two jaws for holding the underside of the hinged box. Both the cover flap and the underside flap are pivotable about an axis of pivoting which lies close to their longitudinal edge facing the turret axis. The pivoting is accomplished by means of respective cam rollers each of which is guided in a separate radial cam of a cam plate. In the hinged box insertion station, the cover flap of the holding means is pivotable from its essentially radially closed position into an open position, and the underside flap can be brought into its essentially radially closed position. In the cassette and supplement insertion station, the cover flap of the holding means can be brought into its essentially radially closed position and the underside flap is pivotable out of its essentially radially closed position into an open position upon engagement with the underside of the box. In the ejection station, the cover flap of the holding means is pivotable out of its essentially radially closed position into an open position while releasing the cover of the hinged box. In this station, the underside flap can be brought into its essentially radially closed position.

In a particularly preferred form of the invention, the cam rollers at the cover flap or at the underside flap are seated adjustably on eccentric pins.

Another feature of the present invention resides in combination of a hinged box delivery belt in which the empty hinged boxes, closed and standing on their narrow longitudinal sides, are moved into a position below the respective holding means situated in the hinged box insertion station. A transfer plate connects to the hinged box delivery belt, the front edge of the transfer plate facing away from the delivery belt and is aligned with the inside surface of the underside flap which faces the cover flap. A vertically movable ram delivers the frontmost hinged box into a holding means situated in the hinged box insertion station, the ram being disposed following the transfer plate.

A vertical braking means that can be brought into contact with the upper side of the approaching hinged boxes is disposed above the transfer plate and a horizontally movable push-back means cooperating with the braking means is disposed following the transfer means. The braking means and the push-back means are preferably operated by a pneumatically actuatable short-stroke cylinder.

The apparatus may also include a stacking tower and a conveyor drum system as well as a catch basket for the introduction of supplements into a hinged box situated in the cassette and supplement insertion station, with the catch basket having a pivotal leg movable between an open position and a clamping position. The apparatus may also include an elevating platform for lifting cassettes to be inserted from the cassette delivery belt up to the level of the holding means situated in the cassette insertion position.

The apparatus may also be provided with a special supplement introduction station disposed essentially vertically above the hinged box insertion station, the cover flap of the holding means being pivotable into its open position in the special supplement introduction station and the underside flap together with the hinged box situated therein and the cassette plus supplement already introduced into the hinged box are situated in their essentially radially closed position.

The special supplement introduction station may include a stacking tower for accepting special supplements and including a following conveyor drum system as well as a vertically movable stack connected thereto and having an essentially horizontally movable wall. The special supplement is fed therefrom into the hinged box between the supplement and the cassette over a mouthpiece connected to the stack. The mouthpiece may have a retaining means for retracting the cassette from the supplement as well as a tongue for pressing the supplement against the cover of the hinged box, with a vertically movable charger for inserting the special supplement in the gap thus provided.

It is also possible to dispense with the pivotability of the underside flap when an appropriate modification of the remaining structural parts takes place, and to design only the cover flap having the suction means as being pivotable.

BRIEF DESCRIPTION OF THE DRAWINGS

Further features and advantages of the present invention will be apparent from the following description in which an embodiment of the invention is described in detail with reference to the drawings. In the drawings.

DESCRIPTION OF THE PREFERRED EMBODIMENTS

Figure 1:
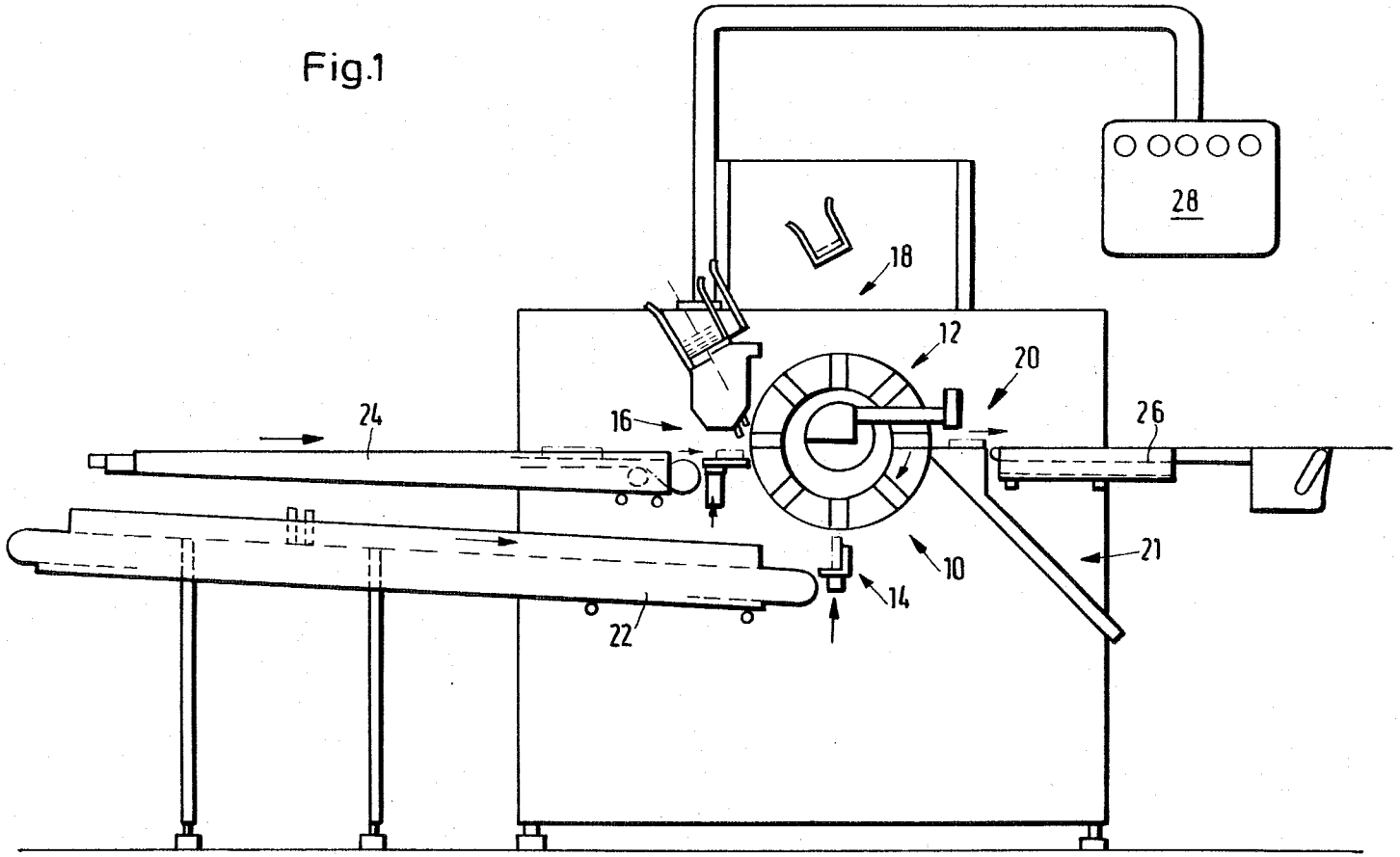
FIG. 1 illustrates an apparatus according to the present invention in a side elevational view, partially broken away.

As shown in FIG. 1, the embodiment of the invention shown in the drawings for the introduction of tape cassettes and supplements into hinged boxes includes a turret 10 disposed with a horizontal axis of revolution, with a total of eight holding means 12 for accepting hinged boxes to be loaded with cassettes as well as supplements. The holding means 12 are disposed at the circumference of the turret 10 and are successively movable into a hinged box insertion station 14, a cassette and supplement insertion station 16, a special supplement introduction station 18 and an ejection station 20. The apparatus also includes a hinged box delivery belt 22, a cassette delivery belt 24 and an ejection belt 26 for completely filled hinged boxes. The overall installation is controlled at a pivotal control housing 28. The apparatus drive as well as the control and recognition of incorrectly introduced hinged boxes, for example jamming hinged boxes as well as incorrectly supplied cassettes and the rejection in a rejection station 21 are similar to those described in DE-OS No. 27 37 196 for the apparatus there disclosed, but having a turret with a vertically disposed axis of revolution.

Figure 2:
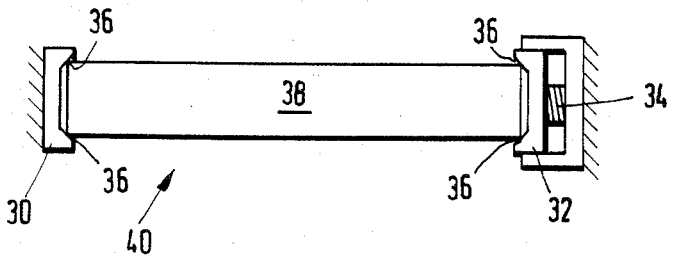
FIG. 2 illustrates the holding jaws for a hinged box in a side view.

FIG. 2 illustrates a holding means 12 which constitutes two retaining jaws 30, 32. The retaining jaw 30 is rigidly connected to the holding means 12 and may be integral therewith whereas the retaining jaw 32 is displaceable in the direction toward the fixed retaining jaw by the action of springs 34. The dimensional tolerances of the hinged boxes can thus be compensated. The retaining jaws 30, 32 have inner faces 36 disposed at an angle of about 90° relative to one another and are extending at an angle of about 45° relative to the lateral faces of the hinged box. The sections 36 have only line contact with the hinged box 38 so that it is assured that no scratching can occur at the narrow sides of the hinged boxes. The spring tension of the spring 34 is adjusted so that the hinged box 38 is just held within the jaws.

Figure 3:
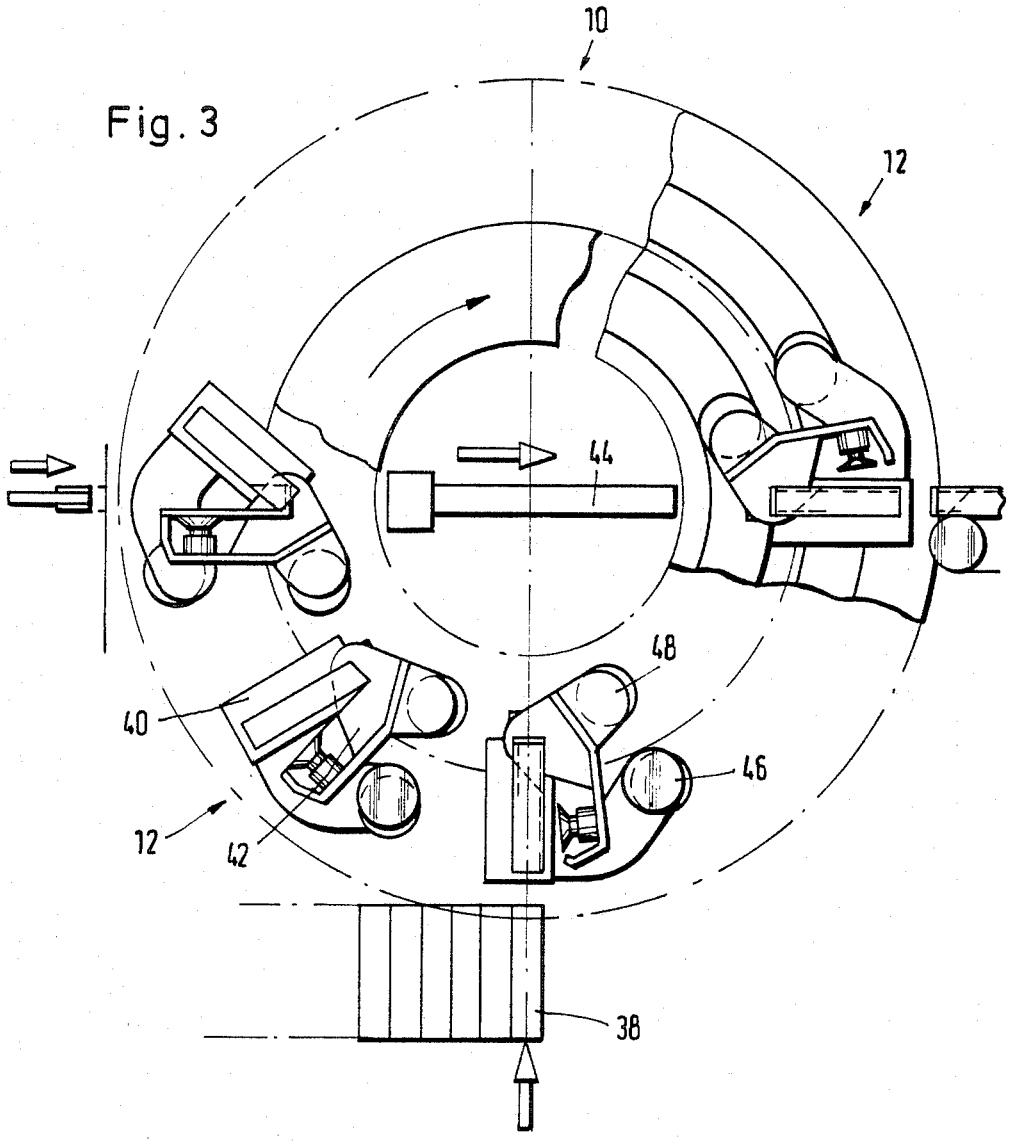
FIG. 3 illustrates the turret of the apparatus in a side elevational view.

FIG. 3 shows an individual holding means 12 which comprises an underside flap 40 containing the retaining jaws 30, 32 shown in FIG. 2 and also comprises a cover flap 42. Both the cover flap 42 as well as the underside flap 40 are pivotable about pivotal axes lying parallel to the axis of revolution 44 of the turret 10 as clearly indicated in FIG. 3. The movement of the cover flap 42 as well as of the axis of revolution 44 by the step-by-step advancement of the turret is effected by means of cam rollers 46, 48 which are positively constrained in a separate radial cam of a stationary cam plate. For purposes of better adjustability, the cam rollers 46, 48 are seated on eccentric pins in the flaps 40, 42 as also shown in FIG. 3.

Figure 4:
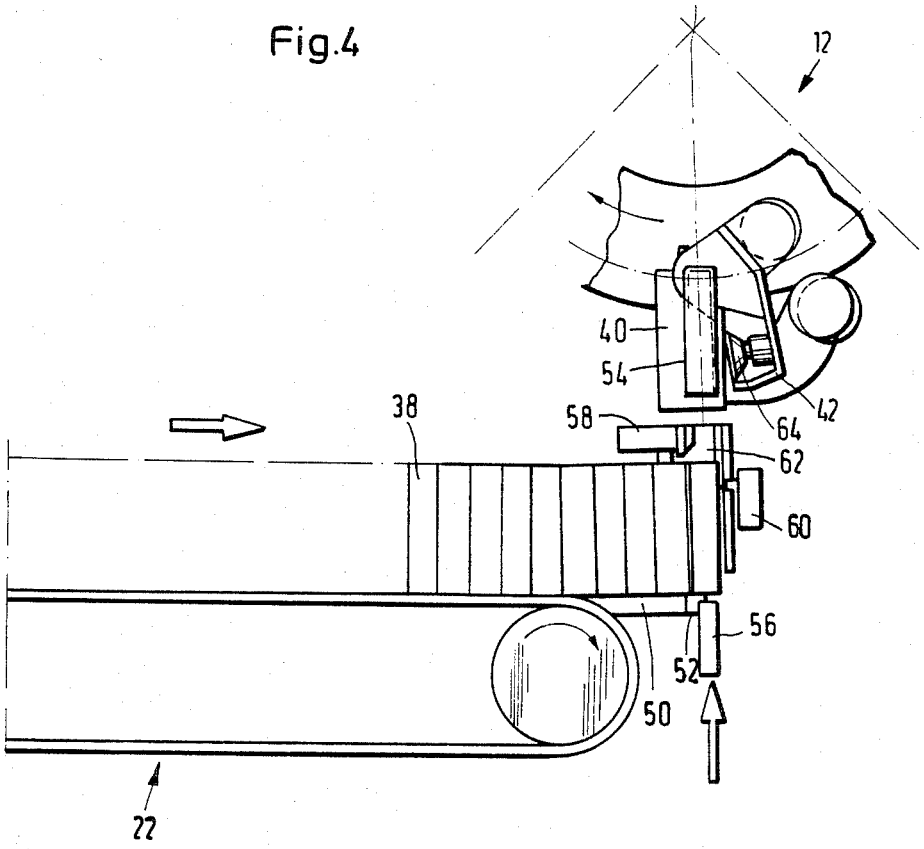
FIG. 4 illustrates the hinged box insertion station of the apparatus in a side elevational view.

FIG. 4 illustrates a transfer plate 50 which is provided following the conveyor belt 22 for supplying the hinged boxes individually to the holders. The front edge 52 of the transfer plate faces away from the conveyor belt 22 and is essentially aligned with the inside surface 54 of the underside flap 40 that faces the cover flap 42. There is also shown a vertically movable loading ram 56 which is disposed following the transfer plate 50 and also a vertically movable braking means 58 above the transfer plate 50 that can be brought into contact with the upper side of the approaching hinged boxes 38. Following the transfer plate 50 there is a horizontally movable push-back means 60 which cooperates with the braking means 58 and are jointly operated by a pneumatic short stroke cylinder. The hinged boxes 38 are introduced into the respective holding means 12 through a gap 62 by the action of the ram 56 which is vertically movable in the direction of the arrow. FIG. 4 also shows a vacuum-actuated suction means 64 attached to the respective cover flap 42 for grasping the hinged box cover in a particularly tight engagement.

Figure 5:
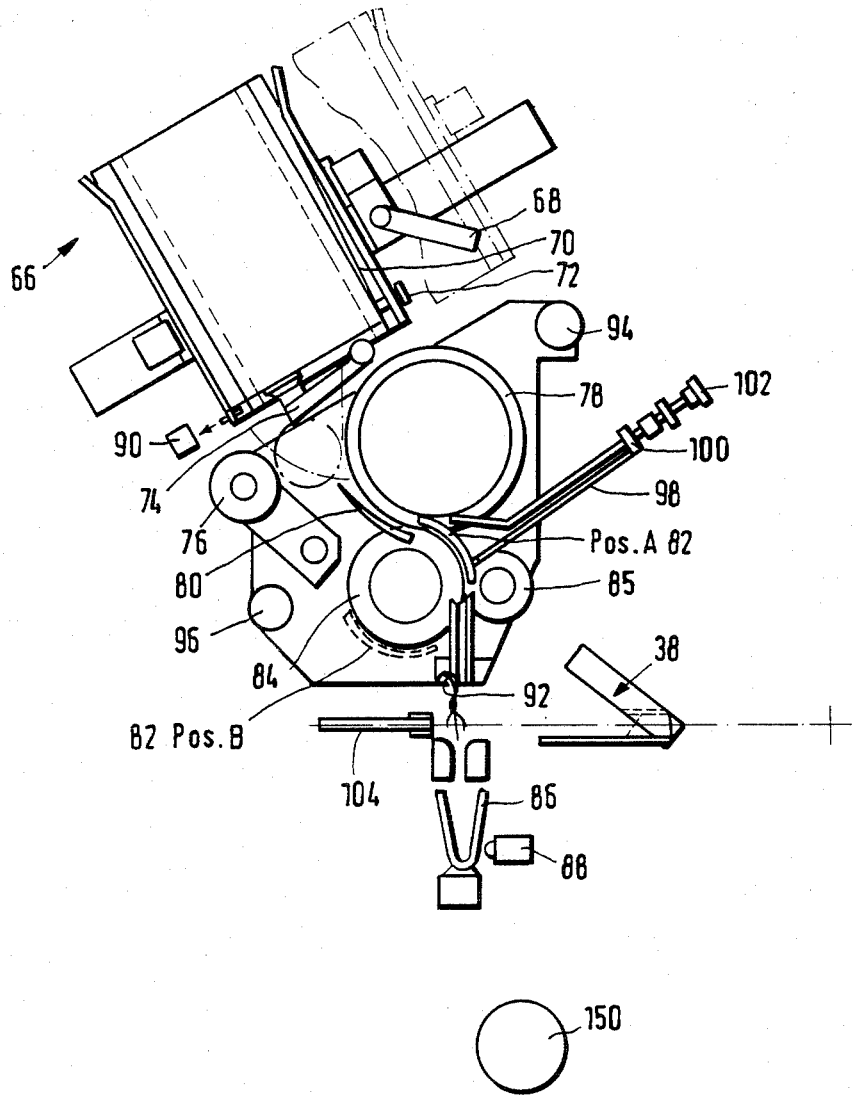
FIG. 5 illustrates the supplement feed of the apparatus in a side elevational view.

As shown in FIG. 5, the supplement feeder may include a stacking tower 66 for the insertion of normal supplements. The width of the stacking tower can be adjusted to a variety of supplement sizes by means of a clamping lever 68 in the manner schematically shown in dashed lines in FIG. 5. Spring plates 70 as well as knurled screws 72 are provided for fine adjustment to the exact supplement size. FIG. 5 also shows a suction arm 74, a puck 76, conveyor drums 78, guide plates 80, 82 as well as rollers 84, 85. A catcher basket 86 receives the supplements in a manner to be described below, the catcher basket 86 being controlled by a reflective light sensor 88.

The supplement feeder shown in FIG. 5 further includes two blow pipes 90,92. Knurled nuts 94,96 serve the function of eliminating jammed supplements as will be explained in a succeeding portion of this description. A folding pocket 98 as well as a stop 100 and knurled screws 102 serve the function of folding longer supplements that must be folded once in the supplement feeder before they are introduced into a hinged box 38 along with a cassette 104.

Figure 6A:
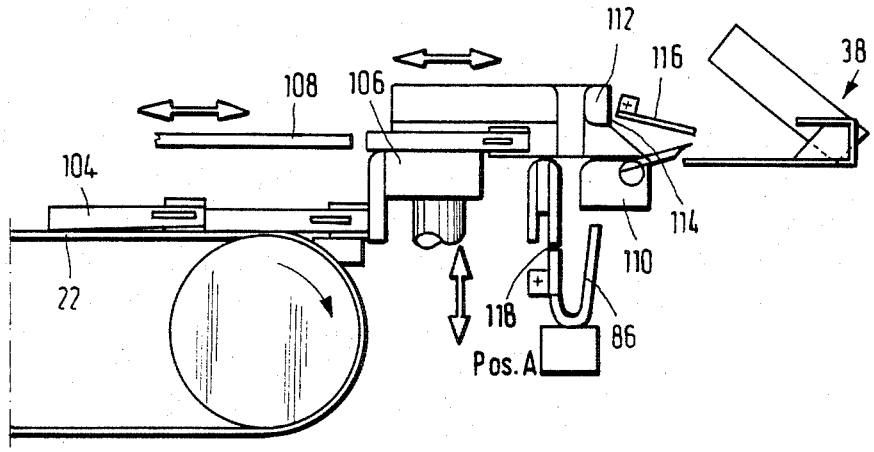
FIGS. 6A and 6B are detailed illustrations of the supplement feed according to FIG. 5 in a side view.
Figure 6B:
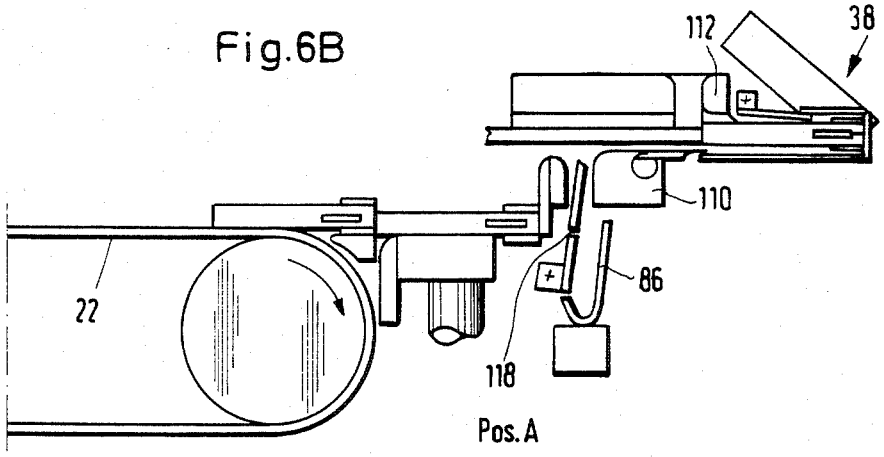

FIG. 6A shows cassettes 104 approaching from the cassette delivery belt 22 and being conveyed on an elevating platform 106. FIG. 6 also shows a horizontally movable charger 108, a stationary mouthpiece 110 as well as a movable mouthpiece 112. A hold-down device 114 as well as a directer 116 serve to introduce the cassette and the supplement into the hinged box 38 in a manner to be described. As shown in the drawing, the catcher basket 86 has a movable flap 118 which is shown in its open position in FIG. 6A and in its closed position in FIG. 6B.

Figure 7:
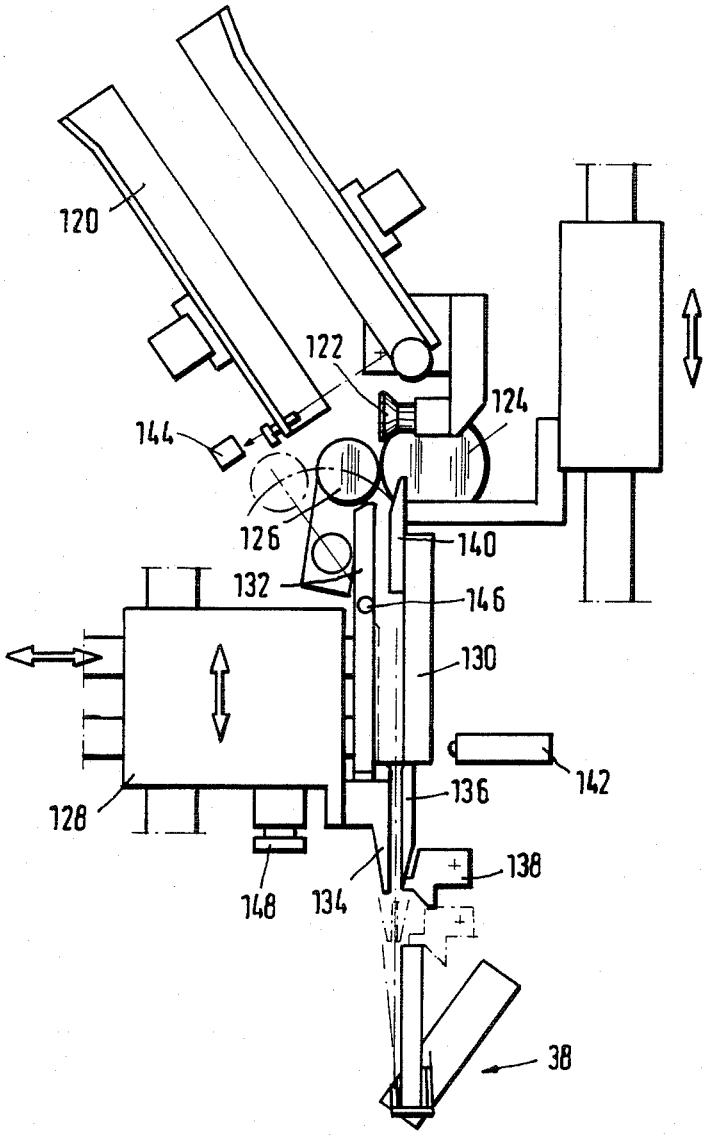
FIG. 7 is an illustration of means for supplying special supplements, shown in a side elevational view.

The special supplement introduction station 18 is shown in FIG. 7. This apparatus has a special supplement stacking tower 120 from which the special supplements can be introduced by means of extractors 122, conveyor rollers 124 and a puck 126 into a stack mounted vertically movable on a compound rest 128. The stack is formed by a stationary wall 130 and a movable wall 132. In the direction toward a hinged box 38, the stack 130,132 is followed by a mouthpiece consisting of a tongue 134 and a lateral part 136. A retainer 138 and a charger 140 complete the feed mechanism. A reflective light barrier 142 as well as air blast feeds 144,146 are provided. The mouthpiece 134,136 can be taken apart by undoing a fixing device 148.

The apparatus described up to now can operate up to 150 cycles per minute depending on the execution, whereby the number of cycles is infinitely variable from, for example, 40 through 150 cycles per minute and is operated in such manner that all principal movements are mechanically carried out by means of cam plates, and a few subordinate movements are pneumatically carried out. Thus, in the examples shown, the connected load of the machine amounts to about 2.2 kW, and additional compressed air at about 6 bar (for the air blast and pneumatic cylinders) is made available for operation. The apparatus provides its own vacuum supply. With the embodiment illustrated, flat as well as singly and multiply folded supplements as well as additional special supplements can be processed. The drive of the turret 10 takes place by means of a central, infinitely variable geared motor. The positioning of the turret 10 is accomplished by means of a step-by-step gearing with quadruple twin division, so that the gearing functions similar to a worm gear as provided with the apparatus shown in DE-OS No. 27 37 196, however with a vertical rotation axis. A revolution of the worm thereby corresponds to a revolution of the main shaft, so that an angle of 360° defines a working cycle of the apparatus.

The operation of the apparatus is as follows:

A hinged box 38 is held in a receptacle compartment or holding means 12 of the turret and is opened for the filling operation and is reclosed when completely packaged. The empty hinged boxes 38 are delivered by means of the conveyor belt 22 (FIG. 4). The boxes are standing on their narrow side, with the hinged side at the top and the cover at the front in the direction of travel. The conveyor belt 22 has a slight forward pitch in order to avoid upsetting of the last hinged box 38 at the end of the line. The speed of the conveyor belt or hinged box delivery belt 22 is controllable. An unnecessarily high slip between the hinged boxes 38 and the material of the hinged box delivery belt 22 can thereby be avoided with a reduced cycle output of the apparatus. In the embodiment illustrated, the hinged box delivery belt 22 is covered with velour or other fabric in order to avoid scratching the hinged boxes to the greatest possible extent. A certain queueing length is required for the transport across the transfer plate 50. This is monitored by reflective light sensors that interrupt the hinged box insertion by means of the ram 56 when the minimum queue is not provided. The hinged boxes 58 run against the stop of the mouthpiece or gap 62 and are pushed into the receptacle compartments of the turret 10 by the loading ram 56. The final position of the ram 56 is monitored by an initiator. In order to avoid an insertion under dynamic pressure, the short stroke cylinder 60 is actuated after the return of the ram 56. The queue runs against the withdrawn ram of the short-stroke cylinder, the penultimate box is decelerated by the short-stroke cylinder of the braking means 58 and, after return of the ram 56 by the push-back means 60, the hinged box 38 can be inserted without dynamic pressure. The underside of the hinged box 38 is held by the retaining jaws 30,32 (FIG. 2) in the holding means 12. As already described, the cover flap 42 has a suction means 64 for holding the cover when opening. The flaps 40,42 are controlled positively constrained over the respective grooved cam, whereby the seating of the cam rollers 46,48 on eccentric pins enables a precise adjustment.

The cassette feed on the cassette delivery belt 24 occurs in such manner that the cassettes lie on the delivery belt with their tape side toward the front, as seen in the running direction. A certain minimum queue is required for the transfer onto the elevating platform 106 (FIG. 6) of the cassette inserter. The minimum queue is monitored by an initiator. When the minimum queue is not present, hinged boxes are no longer inserted. The hinged boxes 38 situated in the turret are still packaged and the apparatus continues to run empty. A reflective light barrier which senses the height differential on the respective cassette serves the purpose of controlling the position of the cassettes. The delivery belt is covered with velour or other fabric in order to prevent scratching of the cassettes to the greatest degree possible.

The cassette and supplement insertion station 16 shown in detail in FIGS. 5 and 6 functions as follows. The supplements are deposited in the stacking tower 66, with a fine adjustment to the exact size of the supplement being accomplished by means of the spring plates 70 and the knurled screws 72. The suction arm 74 picks up a supplement, and then the puck 76 pivots against the conveyor rollers 78. The transport of the supplement into the catcher basket 86 occurs by means of the guide plates 80,82 and the rollers 84,85. For short supplements, the guide plate 82 is situated in the position A shown in FIG. 5 but is in position B for long supplements. The catcher basket 86 is adjustable in height depending upon the type of supplement employed. The height adjustment occurs from the outside by means of the handwheel 150 even when the machine is running. The presence of supplements in the catcher basket 86 is monitored by means of the reflective light sensor 88 whereby the corresponding hinged box 38 is discharged as a reject when no supplements are presents. The blowpipe 90 serves the purpose of separating the supplements during the takeoff, whereas the air coming from the blowpipe 92 accelerates the supplement and prevents them from rebounding in the catcher basket 86. The adjustment of the air blast for the blowpipe 90 and for the blowpipe 92 is accomplished by means of throttles (not shown). The intensity of the air blast is based on the quality and weight of the paper. Suction means of the suction arm 74 are aerated for the purpose of a fast release from the suction means. To this end, the vacuum is disconnected shortly before the removal by the conveyor rollers and the suction means are charged with compressed air.

The entire roller block can be removed from the apparatus for the purpose of greater accessibility in the elimination of jammed supplements. The knurled nuts 94,96 are loosened for this purpose.

Cassette and supplement insertion occurs in such manner that the cassettes delivered by the cassette delivery belt 24 are lifted to the insertion position by means of the elevating platform 106. One supplement is thereby situated in the catcher basket 86. The charger 108 advances the cassette until it is received between the stationary mouthpiece 110 and the movable mouthpiece 112 together with the supplement. In this position, the charger 108 and the mouthpiece 112 jointly run forward with the same speed in the direction toward the hinged box to be charged, i.e., toward the right as shown in FIG. 6.

The hold-down means 114 and the directer 116 facilitate the introduction of the supplement and the cassette into the hinged box 38. At one side, the catcher basket 86 is provided with a flap 118 which resides in the position A shown in FIG. 6A when the supplement is conveyed into the catcher basket 86. Before the insertion, the flap 118 is pivoted into the position B shown in FIG. 6 and prevents unfolding of the folded part of long supplements in this position. The elevating platform 106 is lowered while the supplement and cassette are being inserted into the hinged box 38 so that a new cassette can enter.

The special supplement introduction station 18 of FIG. 7 functions as follows. The supplements are taken off from the stacking tower 120 by the suction means 122 and are conveyed into the stacker mounted on the compound rest 128 being conveyed thereto by means of a conveyor roller 124 and puck 126. The stacker consists of the stationary wall 130 and the movable wall 132. After the special supplement has been conveyed into the stacker 130,132, the compound rest 128 is lowered downwardly. Simultaneously, the special supplement is shifted over the mouthpiece 134,136 by means of the wall 132. After this lowering, the tongue 134 presses the standard supplement already situated in the hinged box 38 against the cover of the box 38 and the retractor 138 pulls the cassette back so that a gap arises into which the special supplement is inserted by means of the charger 140. The presence of special supplements in the stacker 130,132 is monitored by the reflective light barrier 142. When the special supplement is missing, the hinged box 38 is discharged by the reject ejector (not shown). When this error occurs three times in succession, the apparatus stops because there is either a permanent error in the special supplement transport or the magazine in the stacking tower 120 is empty. A corresponding malfunction lamp at the control housing 28 indicates this condition.

The air blast from the air blast feeder 144 serves to separate the special supplements from one another and is adjusted by means of a suitable throttle. The air blast from the air blast feeder 146 accelerates the special supplements and prevents them from rebounding the stacker 130, 132. The air stream can be controlled by means of a throttle, but it can also be changed by means of turning the blowpipe so that the intensity of the air blast is based on the quality and weight of the paper. The mouthpiece 134,136 can be pulled apart for easier removal of crumpled special supplements, made possible after the fixing means 148 has been loosened.

The features of the present invention described in the above description and drawings can be used individually as well as in combination for the realization of the invention in its various embodiments.

I claim as my invention:

1. In an apparatus for introducing tape cassettes or the like and supplements into hinged boxes including a turrett arranged to rotate step-by-step on a horizontal axis, a hinged box insertion station located essentially vertically below the axis of said turret and including a plurality of holding means, with means for supplying hinged boxes and inserting the same into said holding means from below, a cassette and supplement insertion station disposed essentially horizontally in the plane of the axis of rotation of said turret, with means for inserting a cassette and a supplement into an at least partially opened hinged box at said cassette and supplement insertion station, an ejection station disposed essentially horizontally in the plane of the axis of rotation of said turret and offset by about 180° from said cassette and supplement insertion station, the improvement which comprises:

said holding means comprising:

a cover flap, a suction device on said cover flap and arranged to open and close the cover of said hinged box, and an underside flap comprising two jaws for holding the underside of said hinged box, both said cover flap and said underside flap being pivotable about an axis close to their longitudinal edges facing the turret axis, and cam rollers engaging said flaps to pivot the same, said cover flap in the hinged box insertion station being pivotable from an essentially radial closed position into an open position, while said underside flap is arranged to be brought into an essentially radial closed position, said cover flap in the cassette and supplement insertion station being arranged to be brought to an essentially radial closed position with said underside flap being pivotable from its essentially radial closed position into an open position upon engagement with the underside of a hinged box, said cover flap in the ejection station being pivotable from its essentially radial closed position to an open position while releasing the cover of said hinged box, with said underside flap being arranged to be brought into its radial closed position.

2. An apparatus according to claim 1 wherein:
said cam rollers are positioned on eccentrically mounted pins.

3. An apparatus according to claim 1 which includes:
a hinged box conveyor system preceding said hinged box insertion station, said hinged box conveyor system including:
a delivery belt,
a transfer plate following said delivery belt, and
a vertically movable ram for inserting a single hinged box into one of said holding means.

4. An apparatus as claimed in claim 3 including:
a vertically movable brake means disposed above said transfer plate, and
a horizontally movable push-back means cooperating with said brake means and disposed beyond said transfer plate.

5. An apparatus as claimed in claim 4 which includes:
a pneumatically operated cylinder operating said brake means and said push-back means.

6. An apparatus as claimed in claim 1 wherein:
said supplement insertion station includes:
a stacking tower,
a conveyor system, and
a catcher basket, said catcher basket having a pivoted leg facing the feed direction of said cassettes and movable between an open position and a clamping position.

7. An apparatus as claimed in claim 6 which includes:
an elevating platform for lifting cassettes from said conveyor system into one of said holding means.

8. An apparatus according to claim 1 which includes:
a special supplement introduction station disposed vertically above said hinged box insertion station,
means in said special supplement introduction station for pivoting the cover flap of said holding means into its open position, and
means for moving the underside flap of each holding means into its essentially radial closed position.

9. An apparatus as claimed in claim 8 which includes:
a stacking tower for receiving special supplements,
a conveyor system for receiving special supplements from said stacking tower,
a vertically movable stack following said conveyor system and having a longitudinally movable wall, and
guide means for feeding a supplement from said vertically movable stack into a hinged box.

10. An apparatus according to claim 9 wherein:
said guide means includes a mouthpiece including a retainer and a tongue for pressing a supplement against the cover of a hinged box, and
a vertically movable charger for inserting the special supplement into the gap thus provided.

* * * * *